US006056192A

United States Patent [19]

Cameron

[11] Patent Number: 6,056,192

[45] **Date of Patent: *May 2, 2000**

[54] RECTANGULAR-FACED ENCLOSURES

[76] Inventor: Robert Cameron, 63 Mailing Avenue, Bishopsbriggs, Glasgow, Scotland, United Kingdom, G64 1DT

[ * ] Notice: Under 35 U.S.C. 154(b), the term of this patent shall be extended for 362 days.

[21] Appl. No.: 08/782,243

[22] Filed: Jan. 14, 1997

Related U.S. Application Data

[63] Continuation-in-part of application No. 08/439,990, May 12, 1995, abandoned.

[51] Int. Cl.[7] ..... B65D 27/00

[52] U.S. Cl. ..... 229/75; 229/92.1

[58] Field of Search ..... 229/75, 92.1, 87.01, 229/92.8

[56] References Cited

U.S. PATENT DOCUMENTS

| | | | |
|---|---|---|---|
| 284,297 | 9/1883 | Hartwell | 229/92.1 |
| 665,796 | 1/1901 | Myers . | |
| 941,525 | 11/1909 | Landenberger | 229/75 |
| 1,035,109 | 8/1912 | Wasmus | 229/75 X |
| 2,005,493 | 6/1935 | Blackwell | 229/92.8 X |
| 2,021,620 | 11/1935 | Weir . | |
| 4,744,509 | 5/1988 | Buchler . | |
| 5,279,456 | 1/1994 | Bernstein | 229/75 X |

FOREIGN PATENT DOCUMENTS

| | | | |
|---|---|---|---|
| 873776 | 7/1942 | France | 229/87.01 |
| 8285 | 3/1901 | United Kingdom . | |
| 553816 | 6/1943 | United Kingdom . | |

*Primary Examiner*—Jes F. Pascua
*Attorney, Agent, or Firm*—Charles J. Brown

[57] ABSTRACT

An improvement in the making of a rectangular envelope by folding adjoining triangular corner flaps on a rectangular sheet, and also in the resulting envelopes themselves and the blank sheets from which they are made, whereby certain sheet edge sections on each pair of adjoining triangular flaps become exactly aligned and partially coincident and an overlap of the last-folded closure flap is of uniform width throughout its length, all by application of particular mathematical formulae.

18 Claims, 7 Drawing Sheets

RECTANGULAR-FACED ENCLOSURES

CROSS REFERENCE TO RELATED APPLICATION

This application is a continuation-in-part of my application entitled RECTANGULAR-FACED ENCLOSURES, filed May 12, 1995, and given Serial No. 08/439,990, now abandoned.

BACKGROUND OF THE INVENTION

In the art of making envelopes from folded sheets, typically but not necessarily of paper, it has long been known to produce square or oblong envelopes from rectangular sheets having triangular flaps on their four corners all of which are folded toward the same face of the sheets.

Certain of these conventional methods include forming an envelope from a rectangular sheet having opposite first and second sheet edges and opposite third and fourth sheet edges with a sheet center point equidistant between the opposite edges. Parallel first and second fold lines extend between the first and third sheet edges and the second and fourth sheet edges respectively and parallel third and fourth fold lines extend at right angles to the first and second fold lines between the second and third sheet edges and the first and fourth sheet edges respectively. This defines a fold rectangle within the edges of the sheet having a center point coincident with the sheet center point, and it also defines first through fourth right triangular flaps beyond the respective first through fourth fold lines with each flap having an apex point at its right angle. The triangular flaps are folded toward the same face of the fold rectangle in any sequence but with the first flap folded last to complete closure and with no apex point of any of the flaps extending beyond the fold line of the opposite flap.

U.S. Pat. No. 2,021,620 to Weir is perhaps the closest single reference disclosing the foregoing conventional practice in folding envelopes from rectangular sheets. Weir teaches opposed pairs of flaps extending beyond respective fold lines which define a fold rectangle and he indicates that the center point of the rectangle should be coincident with the center point of the sheet. His triangular flaps are folded toward the same face of the fold rectangle with no apex point of any of the flaps extending beyond the fold line of the opposite flap.

Certain of these same concepts are disclosed in British Patents Nos. 8285 to Fetherstonhaugh and 553,816 to Chapman and in U.S. Pat. Nos. 4,744,509 to Büchler and U.S. Pat. No. 665,796 to Myers.

Nowhere in the prior art, however, has it been recognized that by application of certain mathematical relationships among the size and dimensions of the sheet and the size and orientation of the fold rectangle and triangular flaps, an envelope can be formed with sheet edge sections on two adjoining flaps exactly aligned and partially coincident and with sheet edge sections on the other two adjoining flaps similarly aligned and partially coincident. In certain oblong forms of envelopes this relationship results in an envelope mouth cleanly defined by two straight sides at right angles to one another, one of which sides is defined by two exactly aligned sheet edge sections on adjoining flaps. Nor did the prior art recognize that the same mathematical relationships can result in the final closure flap overlapping the other flaps with an overlap portion of uniform width throughout its length so that conventional gumming on that overlap portion will result in uniform adhesion throughout its area of contact. Moreover, the prior art did not recognize that the same mathematical relationships can determine the minimum and maximum sheet sizes capable of producing an envelope of a given size with a given overlap width on the final closure flap.

SUMMARY OF THE INVENTION

This invention constitutes an improvement over the prior art methods described above based upon recognition and application of the aforementioned mathematical relationships.

In the improvement of the invention a section of sheet edge on the first flap is aligned and partially coincident with a section of sheet edge on the third flap, and a section of sheet edge on the second flap is aligned and partially coincident with a section of sheet edge on the fourth flap. The improvement of the invention also provides that the flaps overlap upon complete closure with an overlap portion of the first flap on the other flaps along a section of the first sheet edge, measured parallel to the third and fourth fold lines, being of uniform width throughout its length.

These features are embodied according to the invention not only in the method of forming the envelope but also in the enclosure or envelope itself and in the rectangular sheet from which it is formed.

In one specific form of the invention the fold rectangle is square and all of the flaps are of equal size. In another form the fold rectangle is oblong and the first and second flaps are of equal size while the third and fourth flaps are of an equal size different from the size of the first and second flaps. The first and second flaps may be larger than the third and fourth flaps in that oblong form, whereby the enclosure is of banker envelope form. The first and second flaps may be smaller than the third and fourth flaps in that oblong form, whereby the enclosure is of pocket envelope form.

Each apex point of each flap in that oblong form may extend to but not beyond the fold line of the opposite flap, whereby the sheet size is a maximum for a given fold rectangle size. The oblong fold rectangle may have long and short fold lines and the uniform width of the first flap overlap portion, measured parallel to the third and fourth fold lines, may be twice the length of the shortest side of any overlapping acute right triangular tip portions on adjacent flaps, whereby the sheet size is a minimum for a given fold rectangle size.

DESCRIPTION OF PREFERRED EMBODIMENTS

Figure 1A:
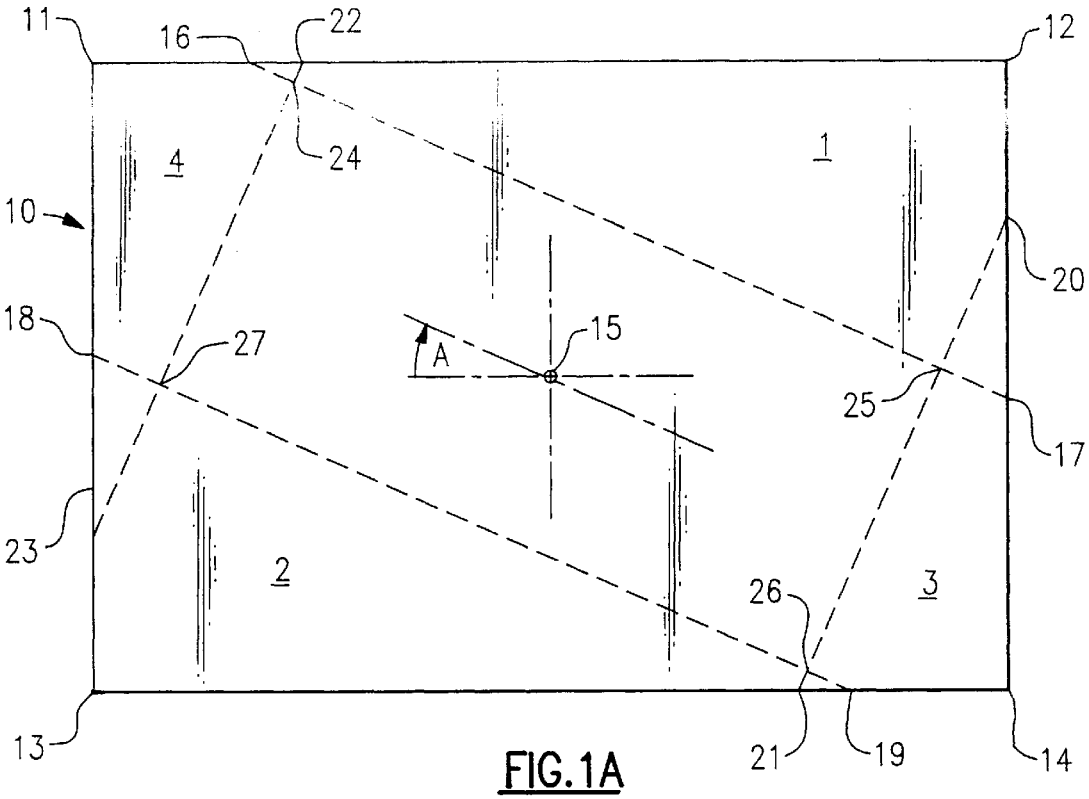
FIGS. 1A to D illustrate the successive folding of flaps of an oblong envelope of banker form according to the invention, where the sheet is neither the maximum nor the minimum for that particular envelope.

To achieve the advantages of the present invention described in general terms in the foregoing summary, the mathematical relationships which rigorously govern the practice of the invention must be understood. They will now be described in relation to one illustrative form of envelope shown in FIGS. 1A to D. In this example an oblong sheet 10 is to be folded into an oblong enclosure of banker form. The sheet 10 is described in reference to various points thereon indicated by respective reference numerals. It has a first sheet edge from point 11 to point 12 and an opposite parallel second sheet edge from point 13 to point 14. (Hereinafter lines or edges between points are identified by two or more hyphenated point reference numerals.) In addition the sheet 10 has a third sheet edge 12-14 and an opposite parallel fourth sheet edge 11-13. The sheet 10 has a center point 15 equidistant between the opposite first and second sheet edges 11-12 and 13-14 and between the opposite third and fourth sheet edges 12-14 and 11-13.

A first fold line 16-17 extends between the first and third sheet edges 11-12 and 12-14 respectively and a second parallel fold line 18-19 of equal length extends between the fourth and second sheet edges 11-13 and 13-14 respectively. Parallel third and fourth fold lines 20-21 and 22-23 of equal length, which are shorter than the fold lines 16-17 and 18-19, extend at right angles to the first and second fold lines 16-17 and 18-19 between the third and second sheet edges 12-14 and 13-14 and the first and fourth sheet edges 11-12 and 11-13 respectively. This defines an oblong fold rectangle 24-25-26-27 within the edges of the sheet 10 having a center point coincident with the sheet center point 15. In addition it defines a first right triangular flap 1 beyond the first fold line 16-17 and an equal and opposite second right triangular flap 2 beyond the second fold line 18-19. It also defines a third right triangular flap 3 beyond the third fold line 20-21 and an equal and opposite fourth right triangular flap 4 beyond the fourth fold line 22-23. The first and second flaps 1 and 2 are larger than the third and fourth flaps 3 and 4. The sheet corners are the apex points of the right angles of the right triangular flaps 1 to 4.

It will be understood that the orthogonal axes of the fold rectangle 24-25-26-27 are thus skewed or rotated clockwise with respect to the orthogonal axes of the sheet 10 at an angle A as shown in FIG. 1A.

In conventional methods of folding a rectangular sheet into an enclosure, the right triangular flaps 1 to 4 are folded toward the same face of the fold rectangle 24-25-26-27 in any sequence but with the first flap 1 folded last to complete closure and with none of the apex points 11 to 14 extending beyond the fold line of the opposite flap.

The present invention is based upon recognition of certain mathematical relationships among the dimensions of the sheet 10 and of the fold rectangle 24-25-26-27 and the angle A of rotation which are necessary to achieve the results described in the foregoing summary of the invention. These relationships can be expressed as follows for yielding a specific size of envelope with a specific closing flap overlap:

Let h=fold rectangle height corresponding to 24–27 and 25–26

L=fold rectangle length corresponding to 24–25 and 26–27 dh=height extension corresponding to 22–24 and 21–26 dL=length extension corresponding to 18–27 and 17–25

Figure 1B:
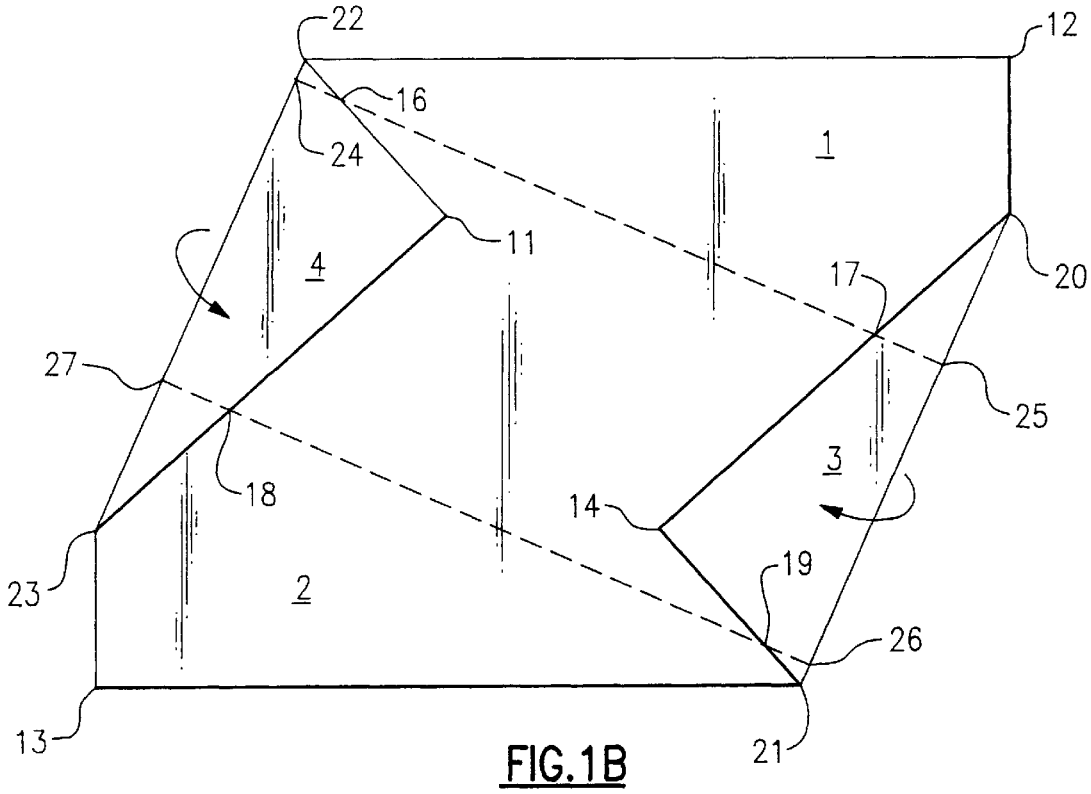
Figure 1C:
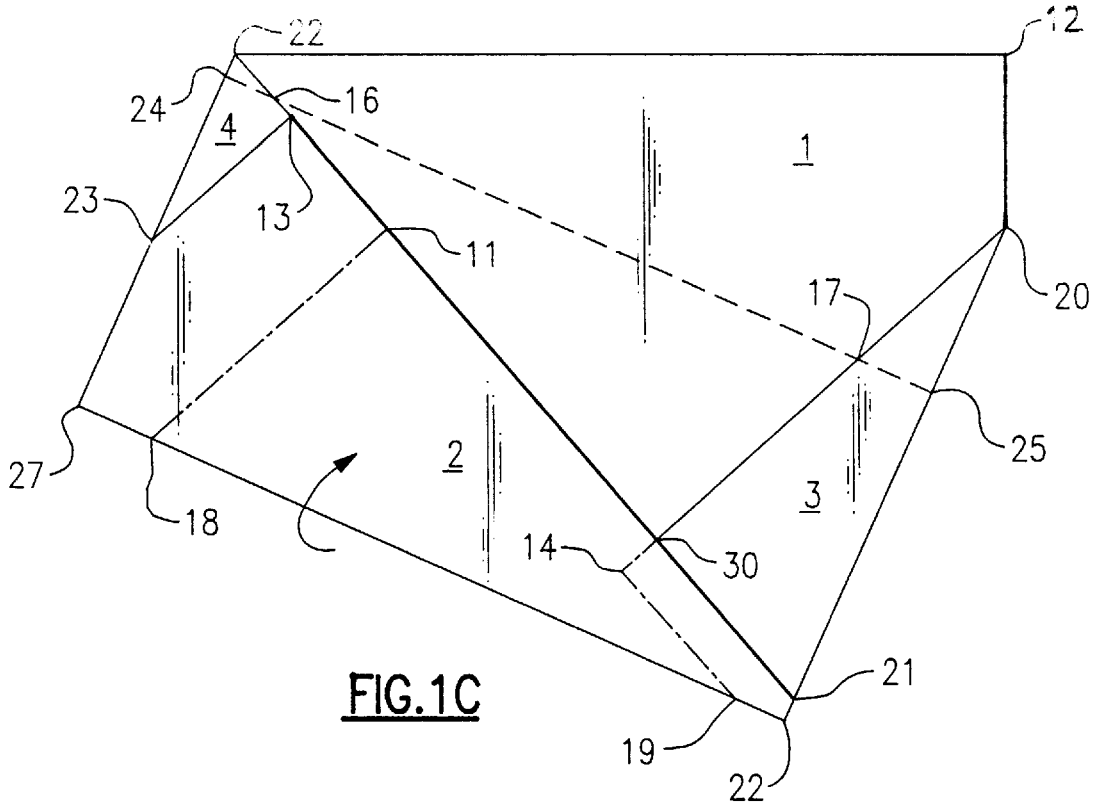
Figure 1D:
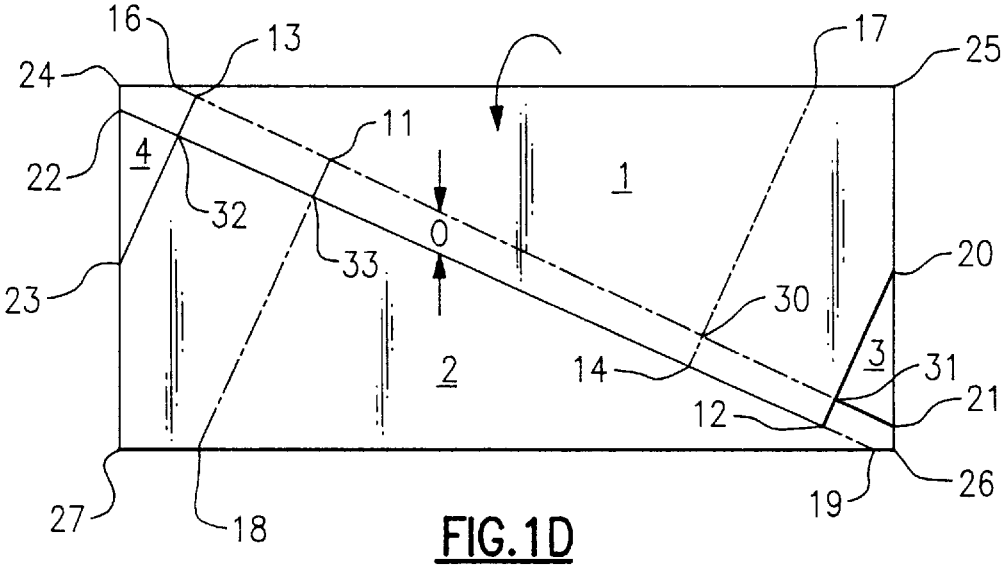

A=angle of rotation o=the width of the overlap portion of the first flap 1 at closure measured parallel to the third and fourth fold lines as shown in FIG. 1D b=breadth of sheet 10 corresponding to 11–13 and 12–14 w=length of sheet 10 corresponding to 11–12 and 13–14

The general formulae necessary for achieving the characteristics of the invention are these:

$$A=\arctan[(h+o-2dh)/L] \quad (1)$$

$$b=(h+2dh)\cos A+L\cdot\sin A \quad (2)$$

$$w=(L+2dL)\cos A+h\cdot\sin A \quad (3)$$

where o=b cos A−2h and dL is greater than or equal to dh

The formulae for arriving at the minimum size sheet capable of producing an envelope of a given size are equation No. 1 above and:

$$b=(h+2dh)\cos A+L\cdot\sin A \quad (4)$$

$$w=(L+2dh)\cos A+h\cdot\sin A \quad (5)$$

in which A=arctan(h/L)

The formulae for arriving at the maximum size sheet capable of producing an envelope of a given size are equations Nos. 1 and 2 above and:

$$w=3h\cdot\sin A=\cos A\,(L-2dh\cdot\text{cotan A}) \quad (6)$$

To produce a fold rectangle 24-25-26-27 of a particular size wherein the overlap o, as defined above, of the first flap 1 at closure along a section 22-12 of the first sheet edge 11-12 is of a particular dimension, only a single angle A will be applicable for a sheet 10 of a given breadth and length. When the above formulae are utilized an envelope results having the characteristics of the present invention which distinguish it over the prior art. Those characteristics summarized previously will now be described in relation to FIGS. 1A to D, in which the general condition is shown where dL is greater than dh.

As shown in FIG. 1B the third and fourth flaps 3 and 4 are folded toward the same face of the fold rectangle 24-25-26-27. Then, as shown in FIG. 1C, the second flap 2 is folded into place overlapping the third and fourth flaps 3 and 4. The sequence of folding to this point is a matter of choice. The second flap 2 may be first folded into place followed by the third and fourth flaps 3 and 4, or the fourth flap 4 may be folded last against the second flap 2, and so on. Whatever the sequence, the second flap 2 overlaps the third flap 3 in the area 26-21-30-14-19, and the second flap 2 overlaps the fourth flap 4 in the area 11-13-23-27-18. At closure the first flap 1 is folded against the other three flaps as shown in FIG. 1D. It then overlaps the second flap 2 at 12-31-13-32, the third flap 3 at 25-20-12-14-17 and the fourth flap 4 at 11-33-22-24-16.

The expressions "overlap" and "overlapping" as used herein are meant to cover coincident areas of any two flaps folded toward one another whether those areas are in physical contact or not. For example, in FIG. 1C the second flap 2 and the fourth flap 4 overlap in contact with one another whereas in FIG. 1D the second flap 2 overlaps the fourth flap 4 with the first flap 1 overlapped on both of them at closure in the area 12-31-30-14. In that area the first and fourth flaps, separated by the second flap, are nonetheless considered to be overlapping. It is a characteristic of the oblong envelope of the invention that there will always be two rectangular areas of two or three, but never more than three, thicknesses of flap when closure is complete, such as the areas 11-13-32-33 and 14-12-31-30 in FIG. 1D.

The first characteristic of the invention resulting from application of the formulae is that a section of sheet edge 22-12 on the first flap 1 is aligned and partially coincident at 14-12 with a section 14-19 of sheet edge on the third flap 3. Also a section 13-21 of sheet edge on the second flap 2 is aligned and partially coincident at 11-13 with a section 11-16 of sheet edge on the fourth flap 4. In the oblong banker form of envelope made in accordance with the invention this alignment and partial coincidence of certain sheet edges on adjoining flaps results in a first edge 22-30 of the mouth of the envelope being defined by the aligned and partially coincident sheet edges of flaps 2 and 4, while a second side of the mouth of the envelope is defined by the sheet edge 20-30 of flap 3. The first and second sides of the mouth are therefore at right angles to one another, as shown in FIG. 1C.

Application of the foregoing formulae also results in the characterizing feature of the invention that the four flaps 1 to 4 overlap one another upon complete closure as shown in FIG. 1D with an overlap portion 12-31-16-22 of the first flap 1 along the section 22-12 of the first sheet edge 11-12 on the other flaps of uniform width o throughout its length. As noted previously the expression "uniform width" for this overlap means the width measured parallel to the fold rectangle sides 25-26 and 24-27 as shown in FIG. 1D, and not perpendicular to the sheet edge section 32-12 on the first flap. Also the "overlap portion" of the first flap 1 is not meant to include the triangular end of the overlap 16-22-24 where, of course, the width is not uniform.

The expressions "enclosure" and "envelope" as used herein, including in the following claims, mean the sheet 10 folded as described whether or not conventional adhesive or gumming is applied to any or all of its overlapping flap portions. Typically, of course, moisture-activated adhesive will be applied on certain of the flap overlap portions which are in physical contact with one another and particularly on the uniform width overlap portion 12-31-16-22 of the first flap 1 on the other flaps. However, there are other ways of securing the overlapping flaps together, such as applying adhesive dots or circles spanning the flaps which are to be secured. In some circumstances it may not be necessary to affix the overlapping flaps together at all but to simply leave them folded together to form the enclosure.

In every additional embodiment of the invention there are identifiable sheet edges, fold lines, flaps, overlap portions and rotation angles as described above in relation to FIGS. 1A to D. For purposes of clarity the same reference numerals are used in the following descriptions of several other embodiments of the invention.

Figure 2B:
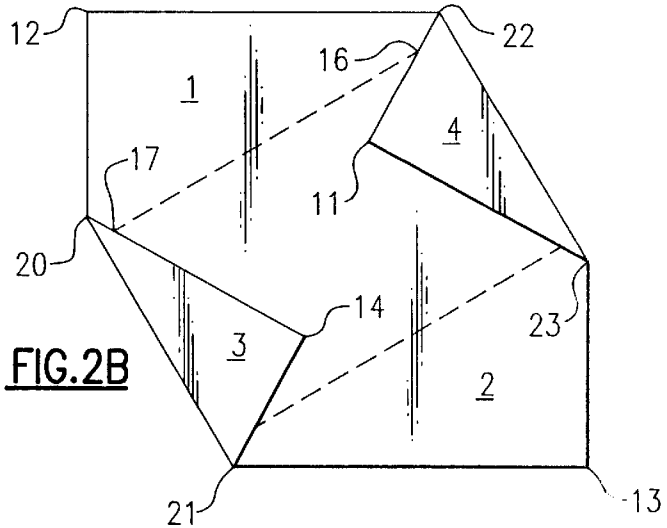
FIGS. 2A to D illustrate the successive folding of flaps of a similar oblong banker envelope according to the invention, where the sheet is of minimum size.
Figure 2A:
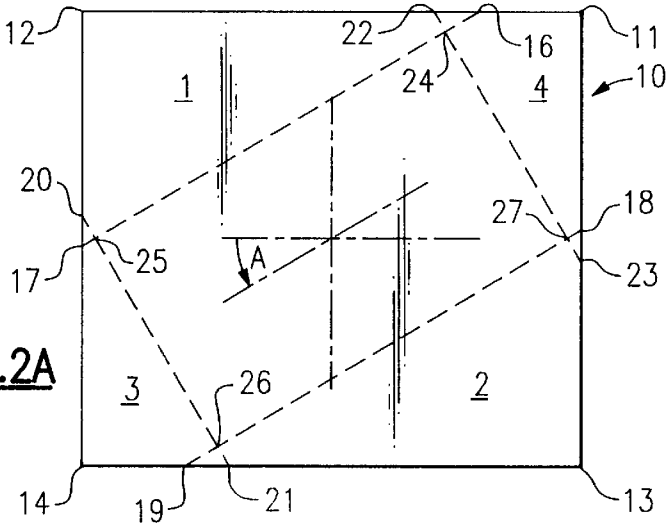
Figure 2D:
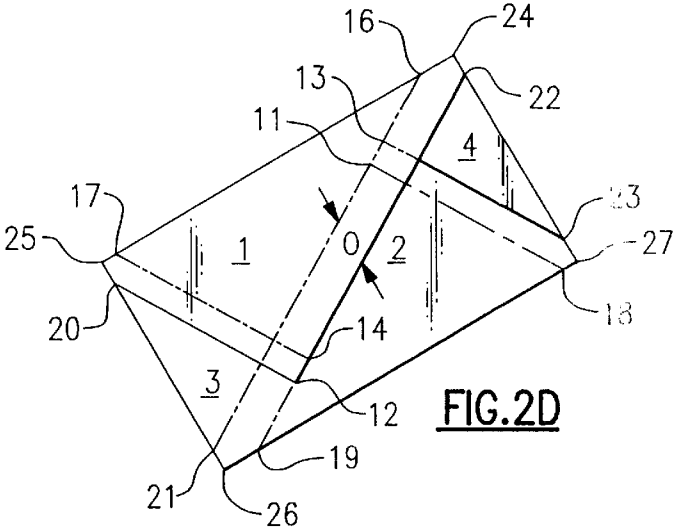
Figure 2C:
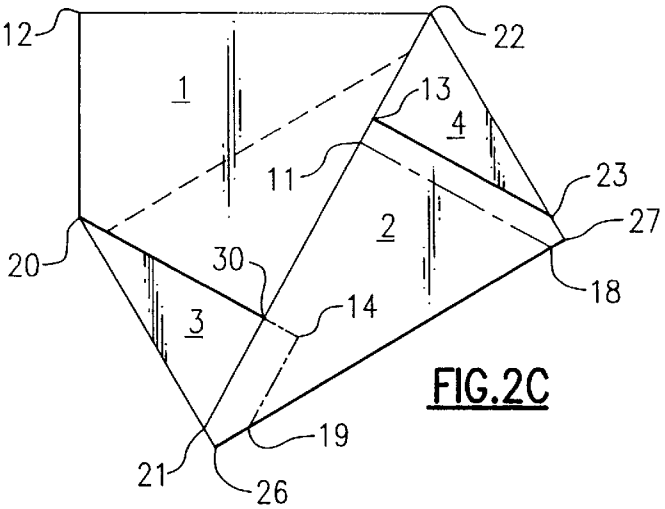

The embodiment of FIGS. 2A to D illustrates a form where the size of the sheet 10 is at a minimum for a given fold rectangle 24-27-26-25 with an angle A of counterclockwise rotation. This minimum arises when dL equals dh and equations Nos. 1, 4 and 5 apply. Hence the first flap 1 overlaps at closure on the other three flaps as shown in FIG. 2D with the overlap portion, as defined above, being equal in width in all overlapping areas. That uniform width is twice the length of the shortest side of any overlapping acute right triangular tip portions on adjacent flaps, which shortest sides are 22-24, 18-27, 21-26 and 17-25. As in the previous embodiment a section 12-22 of sheet edge on the first flap 1 is aligned and partially coincident at 12-14 with a section 14-19 of sheet edge on the third flap 3. Similarly a section 13-21 of sheet edge on the second flap 2 is aligned and partially coincident at 11-13 with a section 11-16 of sheet edge on the fourth flap 4.

Another feature of the oblong envelopes of the invention illustrated by the embodiment of FIGS. 2A to D is that the closure or first flap 1 has a long edge 12-22 which extends up and to the right as shown in FIG. 2D in contrast to the edge 12-20 in FIG. 1D which extends up and to the left. This is achieved in either of two ways, one of which is by folding the flaps against that face of the fold rectangle 24-25-26-27 opposite to the face against which the flaps are folded in the embodiment of FIGS. 1A to D. Thus the flaps 3 and 4 are reversed in the two embodiments. The other way is by rotating the fold triangle 24-25-26-27 counterclockwise through the angle A rather than clockwise.

Figure 3A:
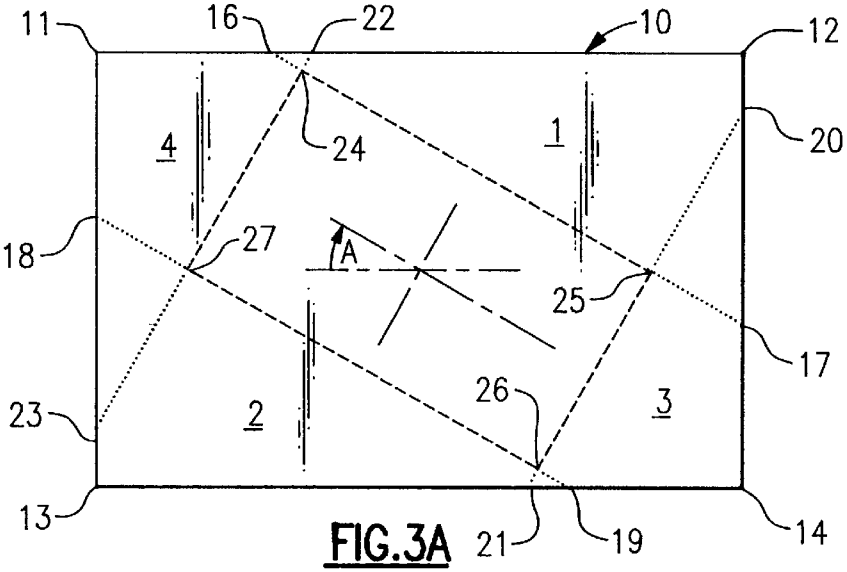
FIGS. 3A to D illustrate the successive folding of flaps of a similar oblong banker envelope according to the invention, where the sheet is of maximum size.
Figure 3B:
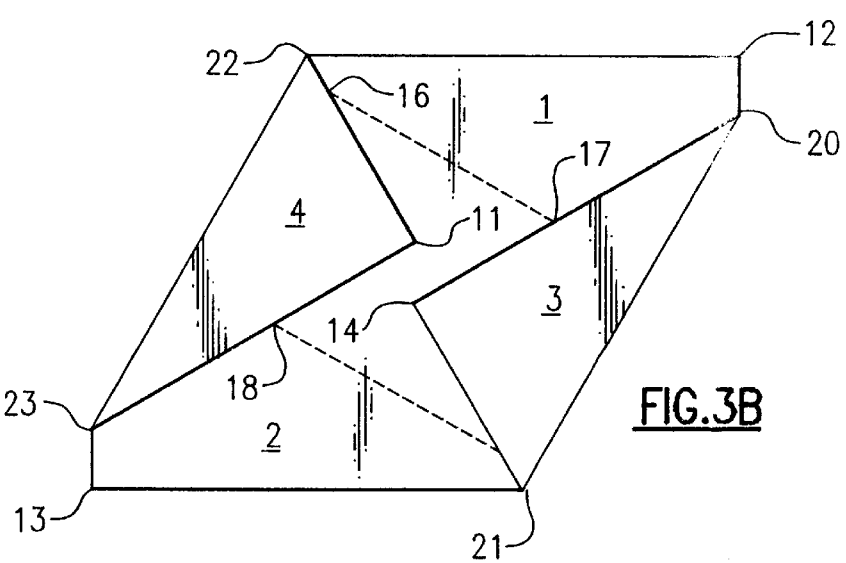
Figure 3C:
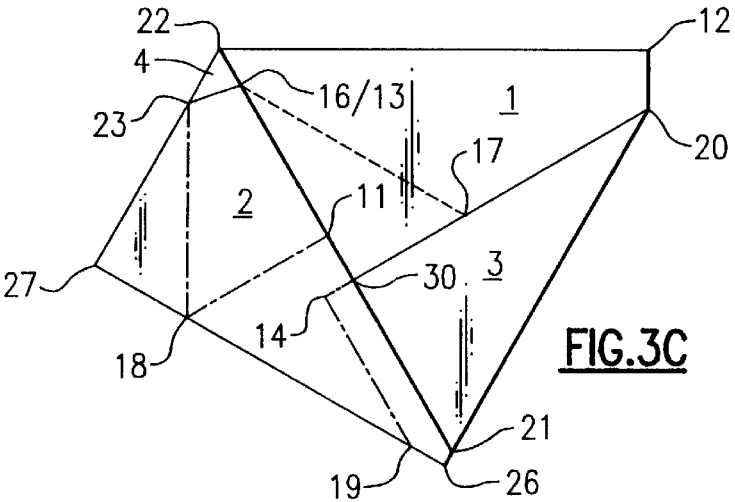
Figure 3D:
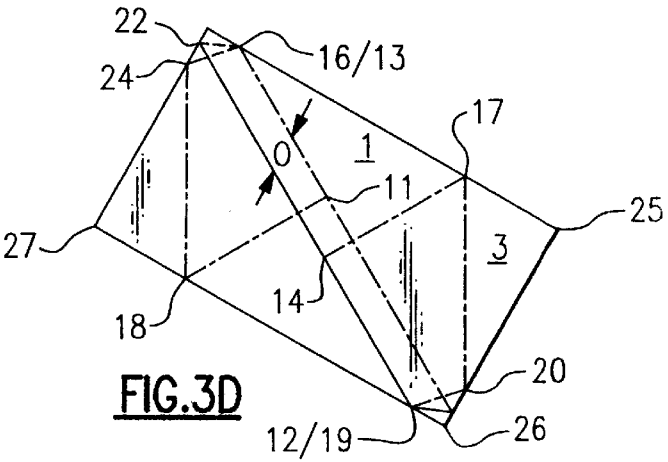

Turning now to FIGS. 3A to D, a form of the invention is shown embodying the largest size sheet 10 which can be utilized with a fold rectangle of a given size and rotation and with a closure overlap of a given dimension. Equations Nos. 1, 2 and 6 apply. The angle A of rotation is clockwise. When the sheet size is a maximum the apex point of each flap 1 to 4 extends to but not beyond the fold line of the opposite flap. So it is that the apex point 13 on the second flap 2 extends to the fold line 16-17 and indeed points 13 and 16 are coincident as shown in FIG. 3C. Similarly the apex point 12 on the flap 1 extends to but not beyond the fold line 18-19. As seen in FIG. 3D the flaps overlap upon complete closure with an overlap portion of the first flap on the other flaps being of uniform width o throughout its length. As in the previous embodiments, a section 12-22 on the first flap 1 is aligned and partially coincident at 12-14 of sheet edge on the third flap 3, and a section 13-19 of sheet edge on the second flap 2 is aligned and partially coincident at 11-13 with a section of sheet edge on the fourth flap 4.

Figure 4A:
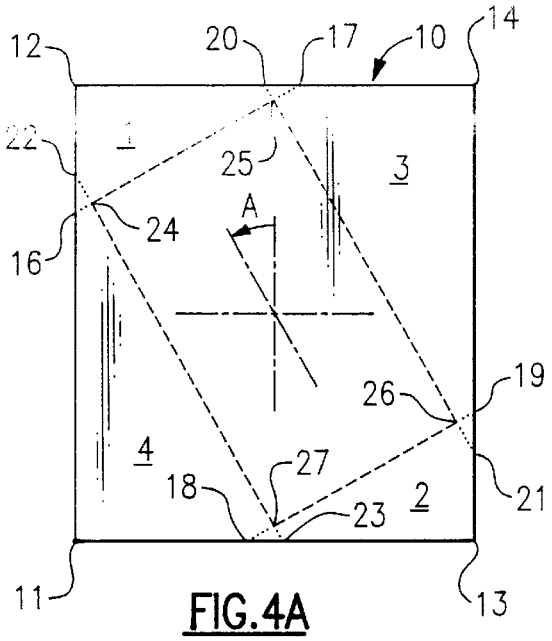
FIGS. 4A to E illustrate the successive folding of four flaps of an oblong pocket envelope according to the invention, where the sheet is neither the maximum nor the minimum for that particular envelope.
Figure 4B:
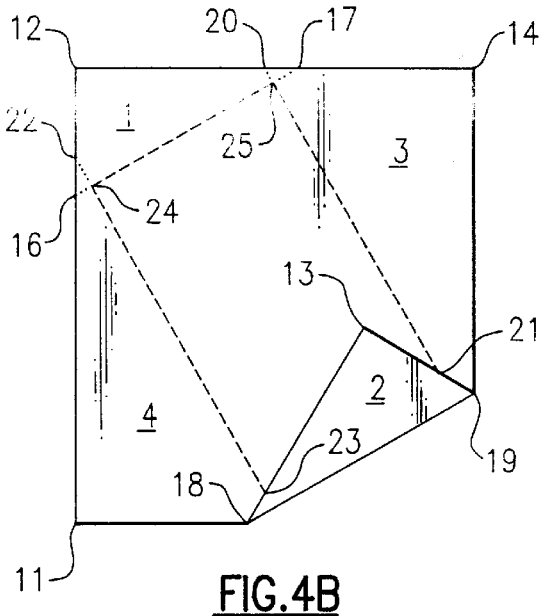
Figure 4C:
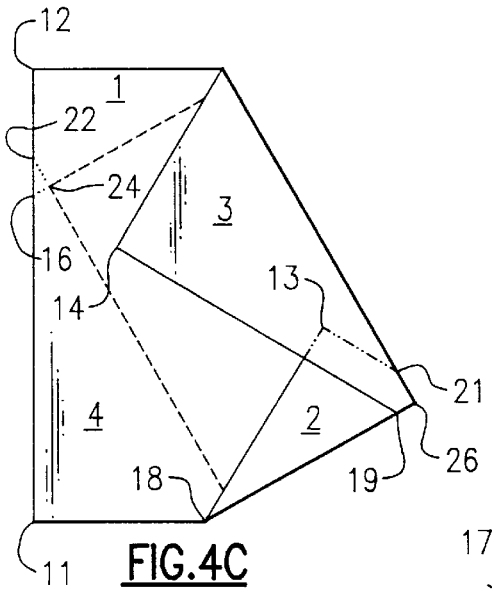
Figure 4D:
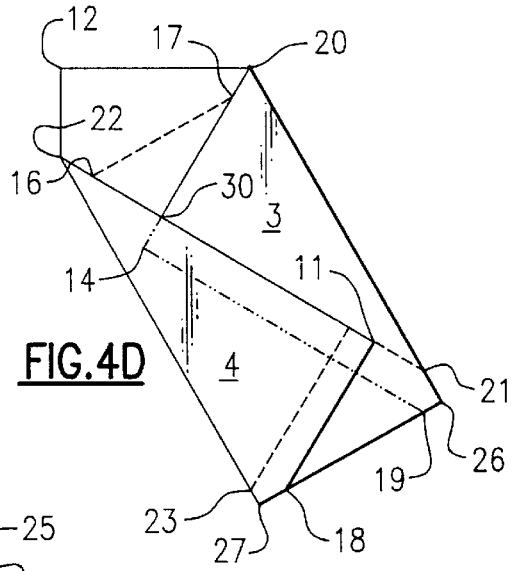
Figure 4E:
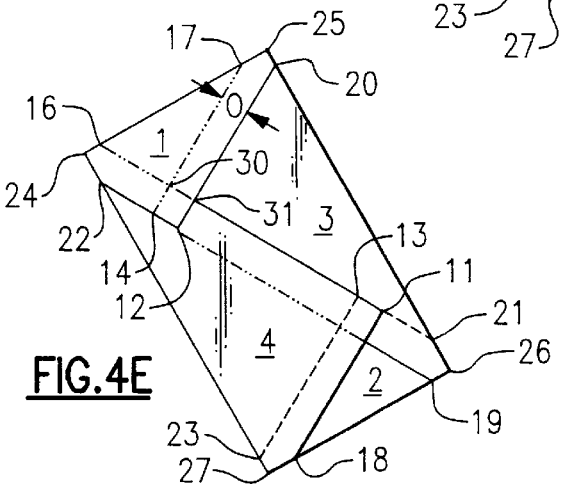

FIGS. 4A to E illustrate a pocket form of oblong envelope made in accordance with the invention. It differs from the foregoing banker forms in that the first flap 1 is folded at closure across the short section 24-25 of the fold line 16-17 as shown in FIG. 4E. Moreover, the first and second flaps 1 and 2 are smaller than the third and fourth flaps 3 and 4, which is the reverse of the size relationship in the banker form of envelopes. As shown in FIG. 4D the mouth of the envelope is formed by an edge section 22-30 on the flap 4 and an edge section 20-30 on the flap 3.

Figure 5A:
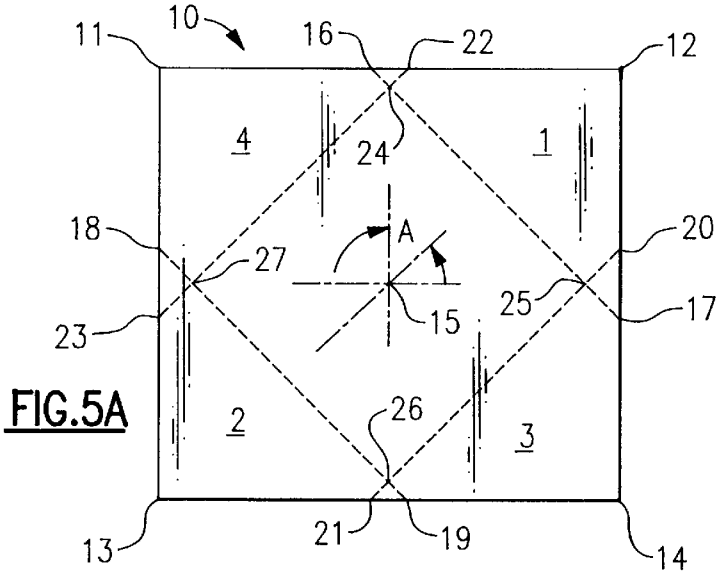
FIGS. 5A to D illustrate the successive folding of four flaps of a square envelope according to the invention, where the sheet is neither the maximum nor the minimum for that particular envelope.
Figure 5B:
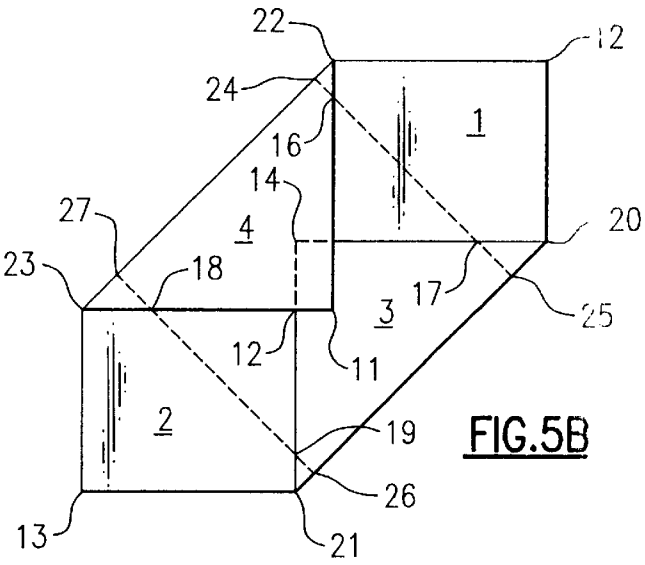
Figure 5C:
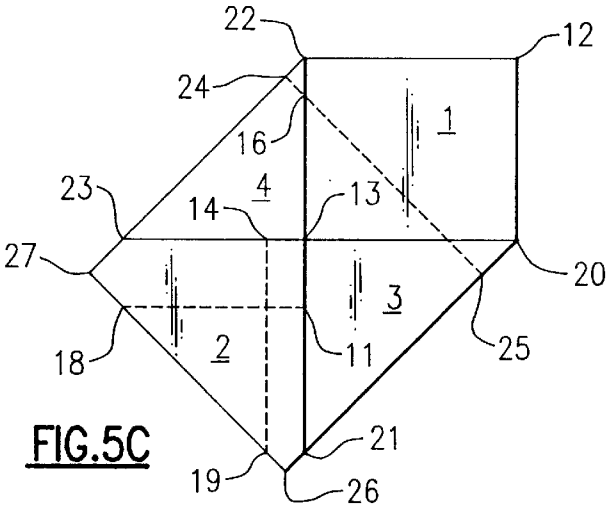
Figure 5D:
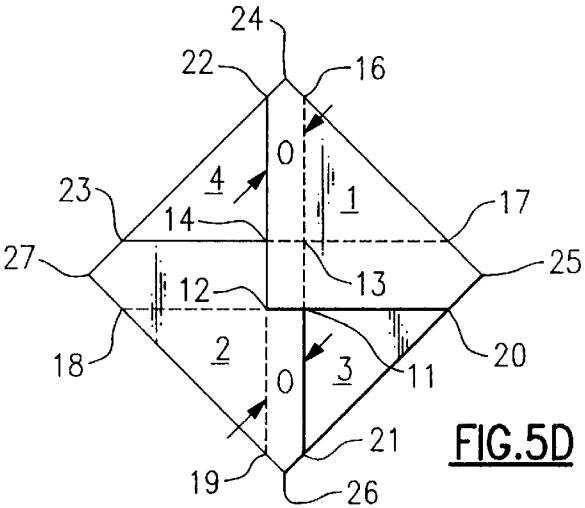

Turning now to the embodiments of FIGS. 5A to D a form of the invention is shown wherein the fold rectangle 24-25-26-27 is square. The angle A of rotation is therefore 45° applying the previously described formulae, the same relationship of edges, fold lines, overlaps and so forth described in relation to the foregoing embodiments is achieved in this embodiment as well. A section 12-22 of sheet edge on the first flap 1 is aligned and partially coincident at 14-12 with a section 14-19 of sheet edge on the third flap 3. Similarly, a section 13-21 of sheet edge on the second flap 2 is aligned and partially coincident at 11-13 with a section 11-16 of sheet edge on the fourth flap 4. As in the previous embodiments the flaps overlap upon complete closure with an overlap portion o of the first flap 1 on the other flaps of uniform width throughout its length as shown in FIG. 5D. It is to be noted that in this square envelope embodiment there are five thicknesses of sheet overlapping in the area 11-12-14-13.

Figure 6:
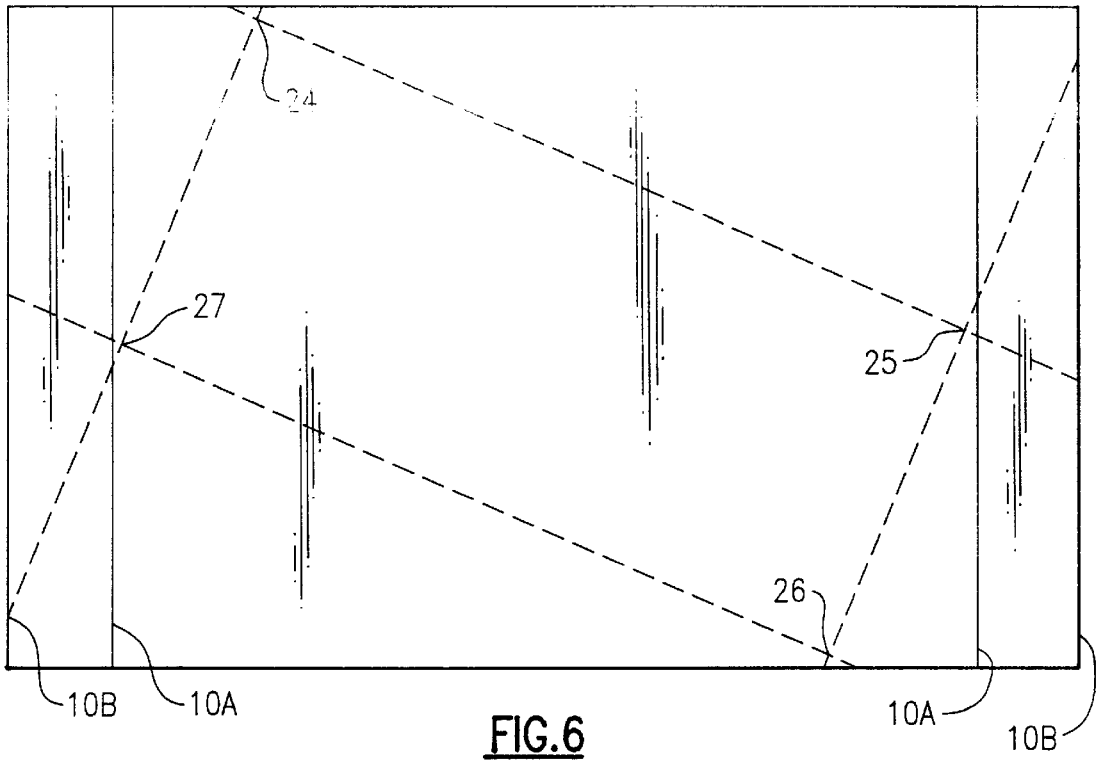
FIG. 6 is an illustration of a particular envelope and the minimum and maximum size sheets of equal breadth from which it can be made.

Turning now to FIG. 6 a specific example is shown for the application of the formulae of this invention to a typical envelope known in the United States as a #9 having nominal measurements of 3⅞ inches×8⅞ inches. In its conventional form such an envelope is prepared by folding an equi-sided diamond (lozenge) or rhombus with a side of approximately 10¼ inches and opposing internal acute angles measuring approximately 45°. The overlap gumming width of a conventional #9 envelope is approximately 9 mm (⅜ in.). The surface area of the diamond (lozenge) is approximately 50,000 sq.mm. (77.5 sq.in.) The fold rectangle 24-25-26-27 appearing in FIG. 6 is of the proportions of such a United States #9 envelope.

The sheet 10A in FIG. 6 illustrates the minimum size sheet capable of producing the U.S. 190 9 envelope 24-25-26-27 in accordance with the formulae of the invention. When those formulae are applied the angle A is 23.596°, the breadth or short side of sheet 10A is 188.77 mm (7⁷⁄₁₆ inches) and the length or long side of the sheet 10A is 254.32 mm (10 inches). With the same gumming width of 9 mm (⅜ in.) the surface area of this minimum size sheet according to the invention is approximately 48,000 sq. mm. (74.4 sq. in). The conventional diamond (lozenge) sheet requires approximately four percent more paper than the minimum size sheet according to the invention.

Also illustrated in FIG. 6 by the reference numeral 10B is the maximum size sheet for producing the 190 9 envelope 24-25-26-27 having the same breadth or short side of 188.77 mm (7⁷⁄₁₆ in.) as the minimum size sheet 10A. Since the breadth of both sheets 10A and 10B is the same the overlap o will also be the same.

Applying the foregoing formulae to the 190 9 envelope of FIG. 6, the following values are obtained:

Minimun sheet specification (equations Nos. 1, 2 and 4)

$h = 98.5$ mm $L = 225.5$ mm

Angle $A = 23.596$ degrees $dh = 4.5$ mm

Hence $o = 9$ mm $b = 188.777$ mm (7-7/16 in)

$w = 254.32$ mm (10 in)

Maximum sheet specification (equations Nos. 1, 2 and 6)

$h = 98.5$ mm $L = 225.5$ mm

Angle $A = 23.596$ degrees $dh = 4.5$ mm

Hence $0 = 9$ mm $b = 188.777$ mm (7-7/16 in)

$w = 315.912$ mm (12-7/16 in)

Figure 7:
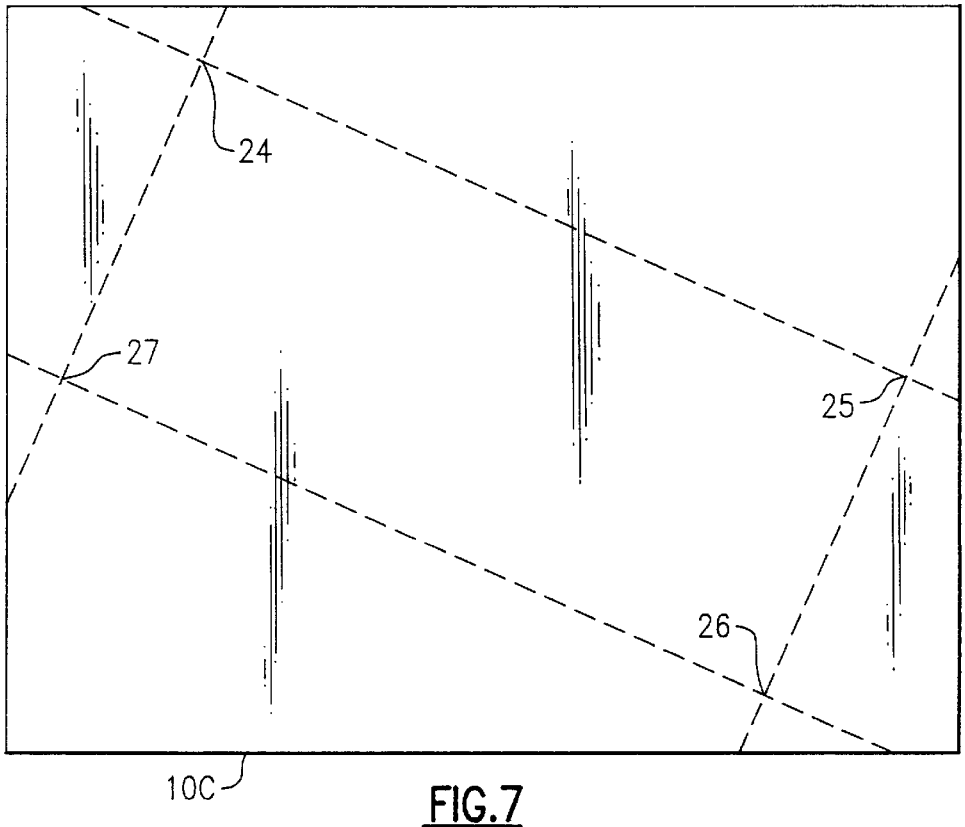
FIG. 7 illustrates how the formulae of the invention can produce a U.S. #9 envelope from a U.S. 8½×11 inch letter size sheet.

FIG. 7 illustrates how the formulae of the invention can result in a U.S. 190 9 envelope by using an ordinary 8½×11 inch sheet of U.S. letter size paper (215.9 mm×279.4 mm).

The result is achieved simply by altering the values of h and L in the formulae very slightly to 100.6 mm and 226 mm respectively, resulting in a fold rectangle rotated at an angle A of 23.995°.

Among the evident advantages of the practice of this invention is that envelopes can be made from rectangular sheets with no cut-outs on the sheet edges which constitute waste of sheet material, though the use of cut-outs along the edges of any sheet 10 would not be a departure from the scope of the present invention. Another advantage of the invention is that certain sizes of sheets and fold rectangles can produce envelopes large enough to contain a sheet of the same size folded laterally in thirds in the conventional manner. The scope of the invention is to be determined by the following claims rather than the foregoing description of certain preferred embodiments.

What is claimed is:

1. In an enclosure formed from a folded rectangular sheet having opposite first and second sheet edges and opposite third and fourth sheet edges with a sheet center point equidistant between the opposite edges, the first and second sheet edges being longer than the third and fourth sheet edges, and wherein parallel first and second fold lines extend between the first and third sheet edges and the second and fourth sheet edges respectively and parallel third and fourth fold lines extend at right angles to the first and second fold lines between the second and third sheet edges and the first and fourth sheet edges respectively, defining a fold rectangle within the edges of the sheet having a center point coincident with the sheet center point and also defining first through fourth right triangular flaps beyond the respective first through fourth fold lines with each flap having an apex point at its right angle, with first and second pairs of opposed right triangular tin portions on said flaps each with its right angle coincident with a corner of the fold rectangle, the triangular flaps being folded toward the same face of the fold rectangle in any sequence but with the first flap folded last to complete closure and with no apex point of any of the flaps extending beyond the fold line of the opposite flap, the improvement which comprises a) a section of sheet edge on the first flap being aligned and partially coincident with a section of sheet edge on the third flap, b) a section of sheet edge on the second flap being aligned and partially coincident with a section of sheet edge on the fourth flap, c) the flaps overlapping upon complete closure with an overlap portion of the first flap along a section of the first sheet edge on the other flaps of uniform width throughout its length, and d) the first pair of right triangular tip portions being of equal size and being at respective opposite ends of a diagonal of the fold rectangle parallel to the longer sides of the sheet and the second pair of right triangular tip portions being of an equal size not more than the size of the first pair.

2. An enclosure according to claim 1 wherein the fold rectangle is oblong and the first and second flaps are of equal size and the third and fourth flaps are of an equal size different from the size of the first and second flaps.

3. An enclosure according to claim 2 wherein the first and second flaps are larger than the third and fourth flaps, whereby the enclosure is of banker envelope form.

4. An enclosure according to claim 2 wherein the first and second flaps are smaller than the third and fourth flaps, whereby the enclosure is of pocket envelope form.

5. An enclosure according to claim 1 wherein each apex point of two opposite flaps extends to but not beyond the fold line of the other opposite flap, whereby the sheet size is a maximum for a given fold rectangle size.

6. An enclosure according to claim 1 wherein the uniform width of the first flap overlap portion is twice the length of the shortest side of any overlapping acute right triangular tip portions on adjacent flaps, whereby the sheet size is a minimum for a given fold rectangle size.

7. In a rectangular sheet foldable into an enclosure and having opposite first and second sheet edges and opposite third and fourth sheet edges with a sheet center point equidistant between the opposite edges, the first and second sheet edges being longer than the third and fourth sheet edges, and wherein parallel first and second fold lines extend between the first and third sheet edges and the second and fourth sheet edges respectively and parallel third and fourth fold lines extend at right angles to the first and second fold lines between the second and third sheet edges and the first and fourth sheet edges respectively, defining a fold rectangle within the edges of the sheet and also defining first through fourth right triangular flaps beyond the respective first through fourth fold lines with each flap having an apex point at its right angle, with first and second pairs of opposed right triangular tip portions on said flaps each tip with its right angle coincident with a corner of the fold rectangle, the triangular flaps being foldable toward the same face of the fold rectangle in any sequence but with the first flap folded last to complete closure and with no apex point of any of the flaps extending beyond the fold line of the opposite flap, the improvement which comprises sizing the flaps so that when folded a) a section of sheet edge on the first flap is aligned and partially coincident with a section of sheet edge on the third flap, b) a section of sheet edge on the second flap is aligned and partially coincident with a section of sheet edge on the fourth flap, c) the flaps overlap upon complete closure with an overlap portion of the first flap along a section of the first sheet edge on the other flaps of uniform width throughout its length, and d) the first pair of right triangular tip portions being of equal size and being at respective opposite ends of a diagonal of the fold rectangle parallel to the longer sides of the sheet and the second pair of right triangular tip portions being of an equal size not more than the size of the first pair.

8. A sheet according to claim 7 wherein the fold rectangle is oblong and the first and second flaps are of equal size and the third and fourth flaps are of an equal size different from the size of the first and second flaps.

9. A sheet according to claim 8 wherein the first and second flaps are larger than the third and fourth flaps, whereby the enclosure is of banker envelope form.

10. A sheet according to claim 8 wherein the first and second flaps are smaller than the third and fourth flaps, whereby the enclosure is of pocket envelope form.

11. A sheet according to claim 7 wherein each apex point of two opposite flaps extends to but not beyond the fold line of the other opposite flap, whereby the sheet size is a maximum for a given fold rectangle size.

12. A sheet according to claim 7 wherein the uniform width of the first flap overlap portion is twice the length of the shortest side of any overlapping acute right triangular tip portions on adjacent flaps, whereby the sheet size is a minimum for a given fold rectangle size.

13. In a method of folding into an enclosure a rectangular sheet having opposite first and second sheet edges and opposite third and fourth sheet edges with a sheet center point equidistant between the opposite edges, the first and second sheet edges being longer than the third and fourth sheet edges, and wherein parallel first and second fold lines extend between the first and third sheet edges and the second and fourth sheet edges respectively and parallel third and fourth fold lines extend at right angles to the first and second fold lines between the second and third sheet edges and the first and fourth sheet edges respectively, defining a fold rectangle within the edges of the sheet having a center point coincident with the sheet center point and also defining first through fourth right triangular flaps beyond the respective first through fourth fold lines with each flap having an apex point at its right angle, with first and second pairs of opposed right triangular tip portions on said flaps each with its right angle coincident with a corner of the fold rectangle, the triangular flaps being folded toward the same face of the fold rectangle in any sequence but with the first flap folded last to complete closure and with no apex point of any of the flaps extending beyond the fold line of the opposite flap, the improvement which comprises a) a section of sheet edge on the first flap being aligned and partially coincident with a section of sheet edge on the third flap, b) a section of sheet edge on the second flap being aligned and partially coincident with a section of sheet edge on the fourth flap, c) the flaps overlapping upon complete closure with an overlap portion of the first flap along a section of the first sheet edge on the other flaps of uniform width throughout its length, and d) the first pair of right triangular tip portions being of equal size and being at respective opposite ends of a diagonal of the fold rectangle parallel to the longer sides of the sheet and the second pair of right triangular tip portions being of an equal size not more than the size of the first pair.

14. A method according to claim 13 wherein the fold rectangle is oblong and the first and second flaps are of equal size and the third and fourth flaps are of an equal size different from the size of the first and second flaps.

15. A method according to claim 14 wherein the first and second flaps are larger than the third and fourth flaps, whereby the enclosure is of banker envelope form.

16. A method according to claim 14 wherein the first and second flaps are smaller than the third and fourth flaps, whereby the enclosure is of pocket envelope form.

17. A method according to claim 13 wherein each apex point of two opposite flaps extends to but not beyond the fold line of the other opposite flap, whereby the sheet size is a maximum for a given fold rectangle size.

18. A method according to claim 13 wherein the uniform width of the first flap overlap portion is twice the length of the shortest side of any overlapping acute right triangular tip portions on adjacent flaps, whereby the sheet size is a minimum for a given fold rectangle size.

* * * * *

UNITED STATES PATENT AND TRADEMARK OFFICE

CERTIFICATE OF CORRECTION

PATENT NO. : 6,056,192
DATED : May 2, 2000
INVENTOR(S) : Cameron

It is certified that error appears in the above-identified patent and that said Letters Patent is hereby corrected as shown below:

Title page,
[*] delete "362" and insert -- 423 --.

Signed and Sealed this

Sixteenth Day of October, 2001

*Attest:*

Nicholas P. Godici

NICHOLAS P. GODICI
*Acting Director of the United States Patent and Trademark Office*

*Attesting Officer*